US008793899B2

(12) United States Patent
Kroeger et al.

(10) Patent No.: US 8,793,899 B2
(45) Date of Patent: Aug. 5, 2014

(54) CLOSED CYCLE DRYER AND PROCESS FOR DRYING CLOTHES USING SUCH DRYER

(75) Inventors: Thomas Willy Kroeger, Schorndorf (DE); Ralf Haselmeier, Rudersberg (DE)

(73) Assignee: Whirlpool Corporation, Benton Harbor, MI (US)

( * ) Notice: Subject to any disclaimer, the term of this patent is extended or adjusted under 35 U.S.C. 154(b) by 526 days.

(21) Appl. No.: 13/100,326

(22) Filed: May 4, 2011

(65) Prior Publication Data

US 2011/0271547 A1 Nov. 10, 2011

(30) Foreign Application Priority Data

May 10, 2010 (EP) ..... 10162431

(51) Int. Cl.
*F26B 3/02* (2006.01)

(52) U.S. Cl.
USPC ..... 34/381; 34/595; 34/610; 68/20; 8/158

(58) Field of Classification Search
USPC ..... 34/381, 77, 86, 595, 601, 606, 610; 68/5 C, 5 R, 13 R, 19, 20; 8/137, 149, 8/158
See application file for complete search history.

(56) References Cited

U.S. PATENT DOCUMENTS

| | | | | | |
|---|---|---|---|---|---|
| 3,196,553 | A * | 7/1965 | Deaton et al. | 34/534 |
| 3,234,660 | A * | 2/1966 | Williams et al. | 34/527 |
| 3,273,256 | A * | 9/1966 | Behrens | 34/546 |
| 3,739,487 | A * | 6/1973 | Clark | 34/77 |
| 4,603,489 | A * | 8/1986 | Goldberg | 34/77 |
| 5,107,605 | A * | 4/1992 | Yamada et al. | 34/74 |
| 5,228,212 | A * | 7/1993 | Turetta et al. | 34/493 |
| 2007/0101602 | A1* | 5/2007 | Bae et al. | 34/77 |
| 2009/0000040 | A1* | 1/2009 | Ikemizu | 8/158 |
| 2009/0151191 | A1* | 6/2009 | Grunert | 34/480 |
| 2009/0211309 | A1* | 8/2009 | Kawabata et al. | 68/20 |
| 2010/0011608 | A1* | 1/2010 | Grunert et al. | 34/85 |
| 2011/0271547 | A1* | 11/2011 | Kroeger et al. | 34/468 |

FOREIGN PATENT DOCUMENTS

| | | | | |
|---|---|---|---|---|
| DE | 3204718 A1 | 9/1982 | | |
| DE | 3446568 A1 | 7/1986 | | |
| EP | 999302 A1 * | 5/2000 | | D06F 58/20 |
| GB | 2094961 A * | 9/1982 | | F26B 21/08 |

* cited by examiner

*Primary Examiner* — Steve M Gravini

(57) ABSTRACT

A closed cycle dryer comprises a drum, an air blowing unit wherein the air is conveyed to the drum, a heating unit used to heat the air that is blown into the drum, and a condensing unit upstream the heating unit for removing moisture. The dryer further comprises a by-pass between a first portion of the air circuit downstream the condensing unit and a second portion downstream the drum in order to increase the energy efficiency of the drying process.

20 Claims, 4 Drawing Sheets

CLOSED CYCLE DRYER AND PROCESS FOR DRYING CLOTHES USING SUCH DRYER

BACKGROUND OF THE INVENTION

1. Field of the Invention

The present invention relates to a closed cycle dryer comprising a drum, an air blowing unit whereby the air is conveyed to the drum, a heating unit used to heat air that is blown into the drum, and a condensing unit placed upstream the heating unit for removing moisture. The invention relates also to a process for drying clothes in a closed cycle dryer.

2. Description of the Related Art

In the closed cycle dryers the air that receives moisture from the clothes is transferred to a condenser where moisture is removed, and then, after being heated, is supplied back to the drum.

Various solutions have been developed in order to improve the efficiency of the dryers using a closed cycle. For instance, a refrigeration cycle can be used in which the evaporator is used as a condenser for the drying cycle and the condenser of the refrigeration cycle is used as a heating unit. In another solution the condensing unit is provided with water nozzles which cool air and help to remove fluff. Of course these solutions, even if they increase the overall efficiency of the drying process, increase the complexity (and therefore the overall cost) of the dryer.

SUMMARY OF THE INVENTION

It is an object of the present invention to provide a dryer with an improved condensation efficiency thanks to a simple and not expensive modification of the air path in the machine.

Such object is reached thanks to the features listed in the appended claims.

One of the main features of the present invention is the use of a by-pass or short cut which creates a direct link between the outlet of the condensing unit and the outlet of the drum upstream the inlet of the blower. Where a filter is used for removing fluff downstream the drum, the outlet of the by-pass conduit may be placed downstream the filter housing.

According to the invention, the by-pass conduit enables a predetermined part of the process air which has already passed the condensing unit (and is saturated with moisture) to be mixed with the hot and humid air coming from the drum with tumbling clothes (which is not completely saturated with moisture).

According to an embodiment of the invention, the by-pass conduit can be a simple tube that links outlet of the blower downstream the condensing unit and the outlet of the drum or inlet of the blower. Both air flows (from the drum and from the by-pass conduit) will be mixed and will enter the condensing unit more saturated and pre-cooled than without the by-pass.

The unexpected main advantage deriving from the solution according to the present invention is that the energy needed for reaching the 100% humidity line (condensing line) in the Mollier diagram where condensation takes place is reduced if compared to a traditional drying cycle.

Less sensible heat (which would lead to energy losses) needs to be transferred to start condensation. The cooling power of the condensing unit is used more efficiently for the condensation (latent heat/phase change) itself.

Another advantage of the solution according to the present invention is that a part of the process air flow that passes through the by pass conduit reduces the overall resistance that the air blower has to overcome. This leads to higher air flow through the blower and so through the condensing unit as well.

Higher volume flow through the condensing unit, particularly in case a heat exchanger with plates is used, leads to better heat transfer and to higher condensation efficiency. Tests carried out by the applicant have shown an increased process air flow through blower and condensing unit of 10% and above. With the by-pass the overall energy consumption is reduced. According to the result of the above tests, the energy saving is higher than 0.01 kWh/kg dry laundry.

BRIEF DESCRIPTION OF THE DRAWINGS

Further features and advantages of a dryer according to the present invention will be clear from the following detailed description, with reference to the attached drawings in which.

DETAILED DESCRIPTION OF THE PREFERRED EMBODIMENTS

Figure 1:
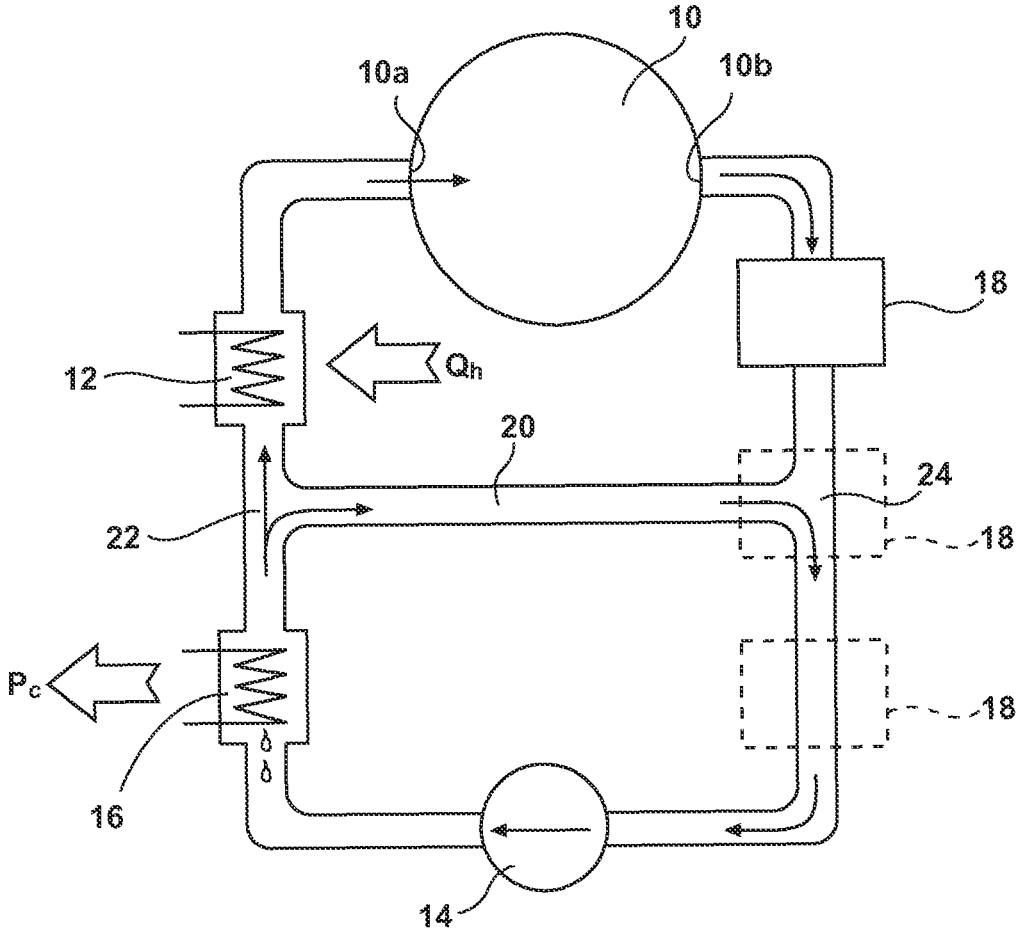
FIG. 1 is a schematic view of a closed cycle dryer according to the invention.

With reference to the drawings, with 10 it is indicated a drum of a clothes dryer using a closed cycle. The drum 10 is fed in 10*a* with hot air heated by a heater 12 in which a heating power $Q_h$ is transferred to air. The flow of air is driven by a blower 14. Downstream the blower 14 and upstream the heater 12, the dryer is provided with a condensing unit 16 for removing humidity (and heat) from the air flow. The cooling power of the condensing unit 16 is identified with reference $Q_c$. The humid air is flowing in 10*b* from the drum 10 and passes through a filter 18 for removing fluff, before reaching the blower 14. The condensing unit 16 could be placed upstream the blower 14 as well (solution not shown in the drawings).

According to the invention, the air circuit of the dryer is provided with a by-pass conduit 20 interposed between, on one side, a portion 22 of the circuit downstream the condensing unit 16 and the heater 12 and, on the other side, a portion 24 of the circuit downstream the filter 18 and upstream the blower 14.

Figure 2:
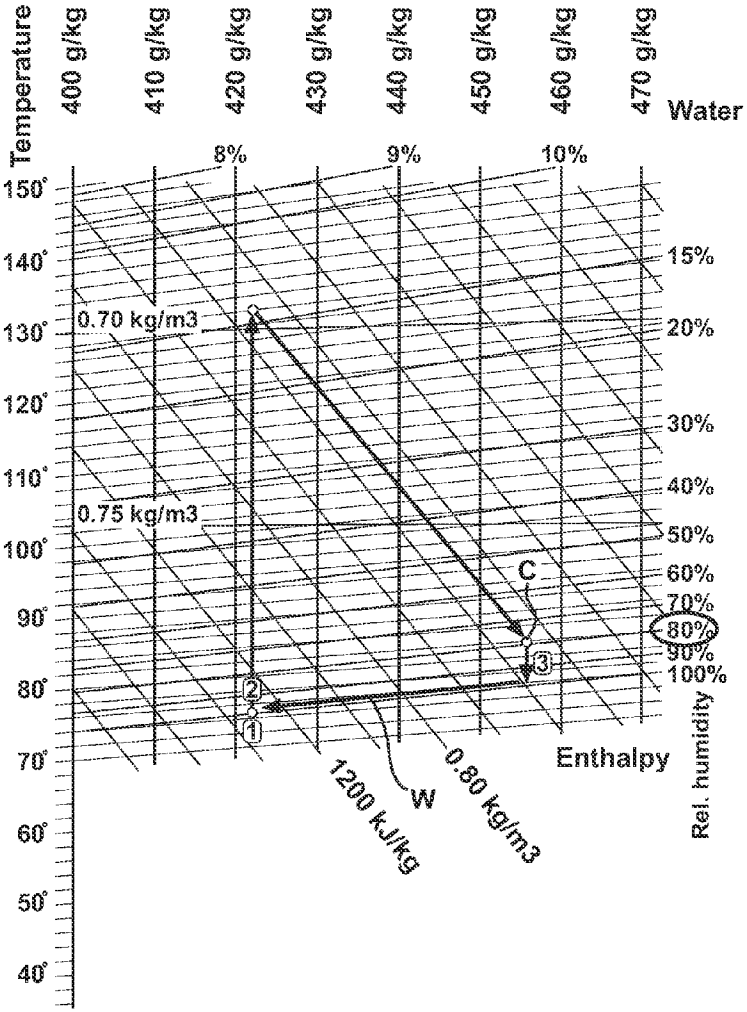
Fig. 2 (PRIOR ART)
FIG. 2 is a drying cycle according to prior art on a Mollier diagram.

In the dryer according to prior art, i.e. without the by-pass conduit 20, the drying process is shown in FIG. 2. Unsaturated air enters the condensing unit at point C of the Mollier diagram. To cool down the air to the condensing line (indicated with reference W in FIG. 2—100% relative humidity) a certain cooling power is needed. Such cooling power is shown by the line identified with reference number 3 in FIG. 2. After cooling in the condensing unit, air needs to be heated up and this leads to further energy consumption. To cool the process air by 1° C. of to heat up such air by 1° C. a power of around 50 W is needed.

Figure 3:
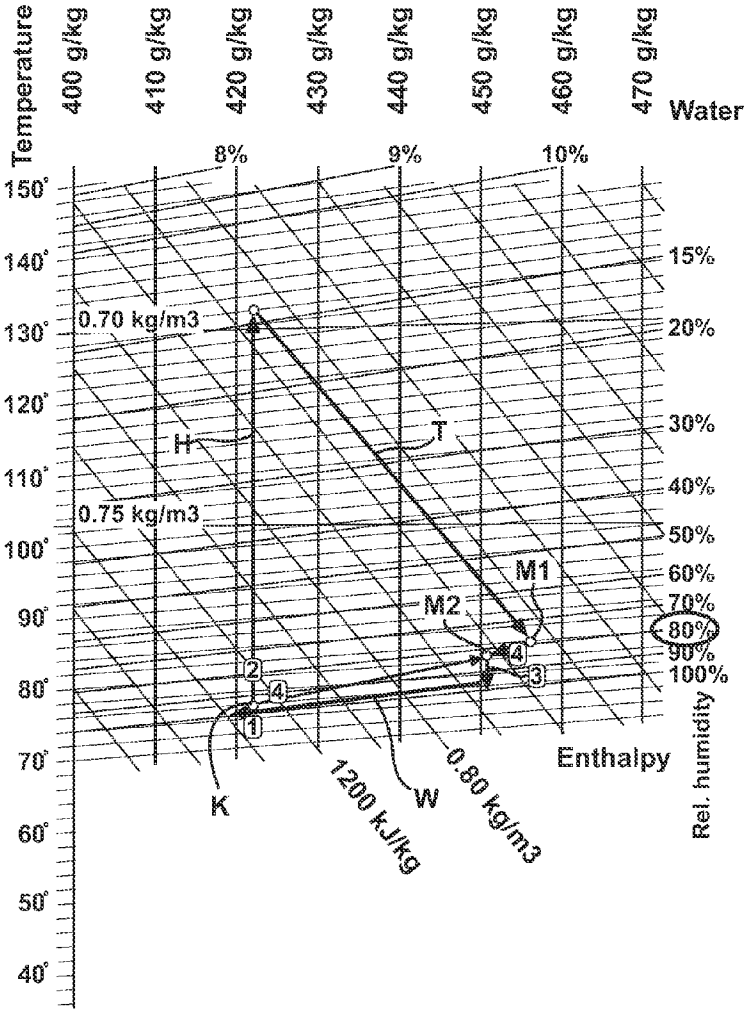
FIG. 3 is similar to FIG. 2 and shows the drying cycle according to the present invention.

The process according to the invention, i.e. with the by-pass conduit 20, is shown in FIG. 3. Line T of the diagram shows the situation inside the drum 10, where energy is transferred from hot air to clothes and therefore to water contained therein for its evaporation (nearly constant enthalpy). In the drum 10 temperature of air from inlet 10*a* to outlet 10*b* is going down, and at the drum outlet 10*b* air is saturated at around 80% with water. Point M1 shows the thermodynamic state of air before being mixed at portion 24 of the circuit. Such air M1 is mixed with air coming out from the condensing unit 16 (point K in FIG. 3). Such mixture changes the state of air along lines 4 and 4' so that the final result of the mixture is air at point M2 with a lower enthalpy than M1. It is therefore clear that for further cooling such air (line 3 in FIG. 3), a lower amount of energy is needed for reaching line W if compared to prior art. This is due to the fact that the mixture of process air (M2) is more saturated and pre-cooled when entering the condensing unit 16. The power saving is comprised between 50 and 100 W. Line H of FIG. 3 shows the heating phase in the heater 12, where absolute humidity remains constant and where relative humidity at the outlet from the heating element 12 is below 15%.

Instead of mixing the two flows of air downstream the filter 18, such mixing can be advantageously carried out in the filter housing (embodiment shown in dotted line in FIG. 1), and this leads to a slightly reduced temperature in filter which increase the filtration efficiency. The filter 18 may also be placed downstream the portion 24 of the circuit where the by-pass conduit 20 flows in the main air circulation conduit (embodiment shown in dotted line, lower right part of FIG. 1).

Figure 4:
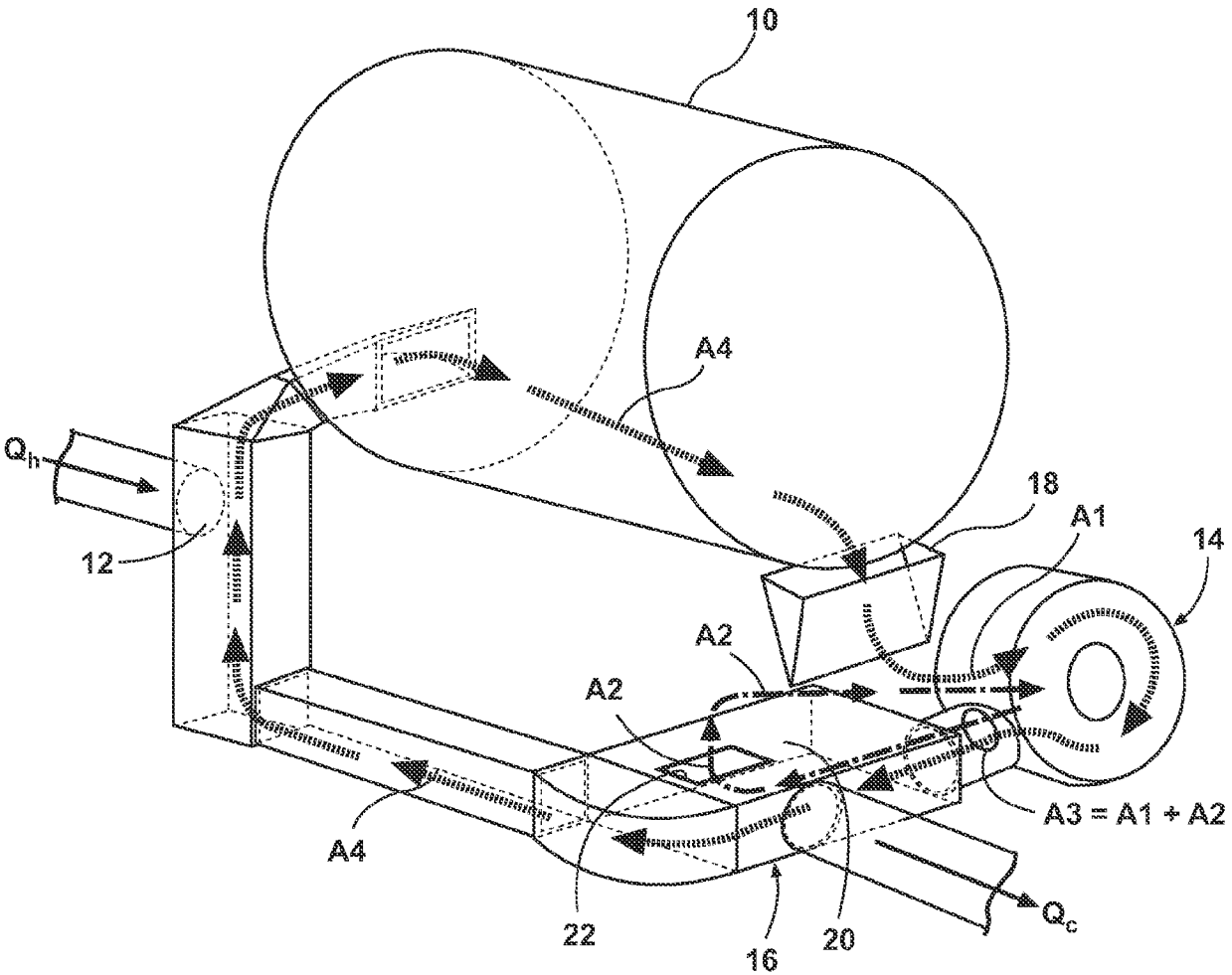
FIG. 4 is a schematic view of a closed cycle dryer with a preferred air path according to the invention.

FIG. 4 shows a preferred embodiment for a dryer having a condensing unit 16 placed at the bottom of the dryer housing and in which the by-pass conduit 20 is defined by a shaped portion of the housing in which the blower 14 is installed, and particularly in which the by-pass is defined by an opening 22 in the housing of the condensing unit 16.

Figure 5:
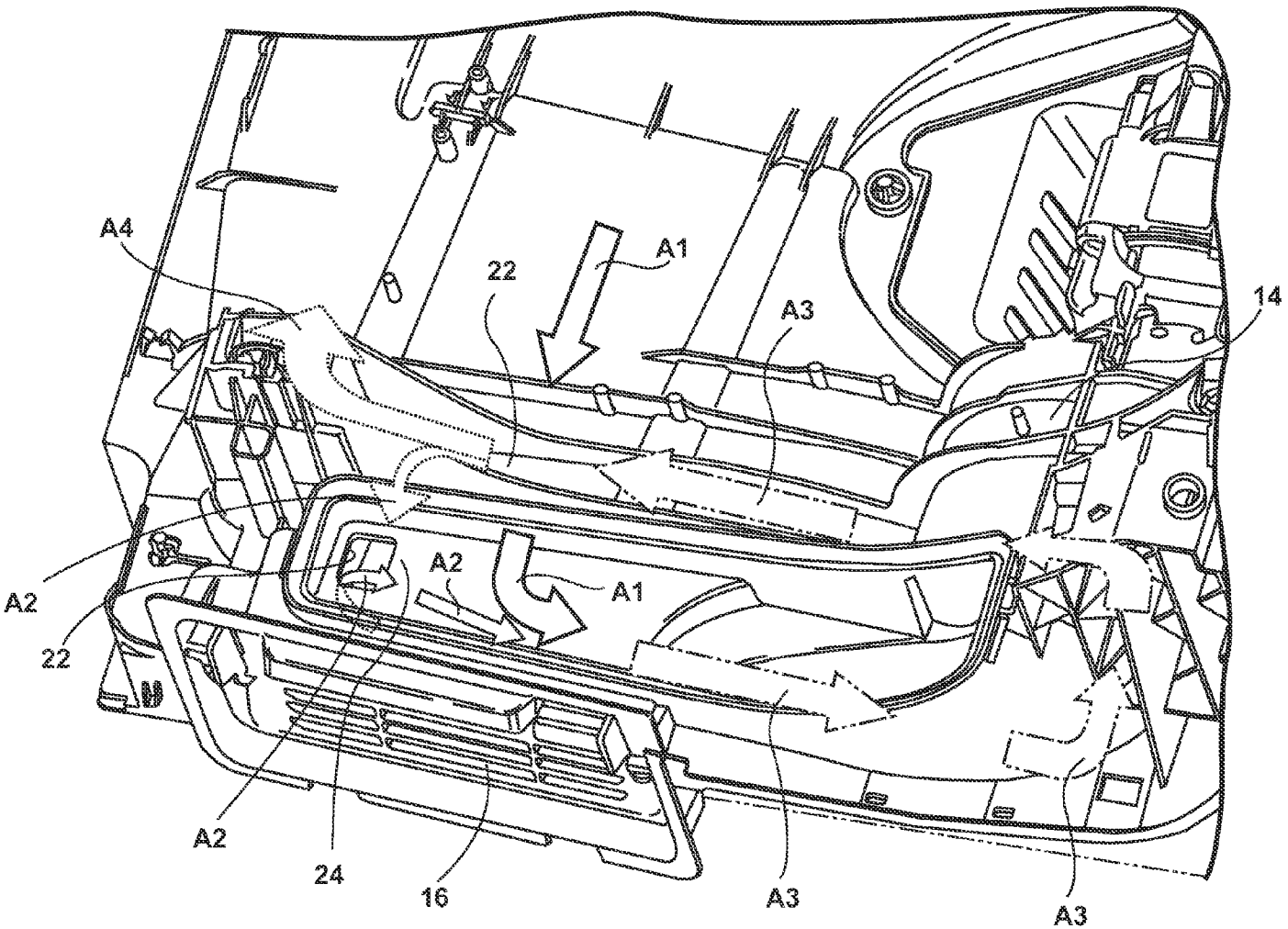
FIG. 5 is a partial and more detailed view of a dryer according to FIG. 4.

FIG. 5 shows an enlarged structural detail of FIG. 4, where the same references used for FIG. 1 have been used. Arrows A1 shows the air coming from the drum. The hot and unsaturated flow A1 is mixed with cold and saturated flow A2 from the opening 22 in the condenser housing. The mixed flow A3 (combination of flows A1 and A2) passes through the blower 14 and the condensing unit and it is split in a primary air flow A4 to the heater and in the by-pass flow A2 to the blower. The solution according to FIG. 5 is particularly efficient since, in order to create a by-pass conduit, it is only necessary to open a part of the condensing unit housing close to the inlet of the blower.

Good results in terms of overall energy efficiency have been obtained with a total air flow through the blower comprised between 210 $m^3/h$ and 250 $m^3/h$, preferably between 220 $m^3/h$ and 240 $m^3/h$, with a fraction of the air flow diverted in the by-pass comprised between approximately 10% and 20%, preferably around 15%.

The following table shows a comparison between the air flows in a closed cycle dryer according to the prior art and according to the invention:

| | Without by-pass $m^3/h$ | With by-pass $m^3/h$ | With by-pass |
|---|---|---|---|
| Complete process air loop | 210 | 200 | −5% |
| Flow through by-pass | 0 | 30 | 15% |
| Flow through condensing unit and blower | 210 | 230 | 110% |

We claim:

1. A closed cycle dryer comprising:

a drum;

an air blowing unit wherein the air is conveyed to the drum;

a heating unit used to heat the air that is blown into the drum;

a condensing unit upstream of the heating unit for removing moisture; and a by-pass between a first portion of the air circuit downstream of the condensing unit and a second portion downstream of the drum.

2. The closed cycle dryer according to claim 1, wherein the first portion of the air circuit is upstream of the heating unit.

3. The closed cycle dryer according to claim 1, wherein the second portion of the air circuit is upstream of the air blowing unit.

4. The closed cycle dryer according to claim 1, further comprising a filter placed in the second portion of the air circuit where there is a mixture of air from the drum and from the by-pass.

5. The closed cycle dryer according to claim 1, wherein the by-pass is defined by an opening of the condensing unit housing.

6. The closed cycle dryer according to claim 5, wherein the opening of the condensing unit housing is close to the inlet of the blowing unit.

7. The closed cycle dryer according to claim 5, wherein the condensing unit is placed at the bottom of a housing of the dryer.

8. The closed cycle dryer according to claim 5, wherein the by-pass flow comprises between approximately 10% and 20% of the total air flow.

9. The closed cycle dryer according to claim 5, wherein the condensing unit is placed downstream of the air blowing unit.

10. A process for drying clothes in a closed cycle dryer having a drum, an air blowing unit wherein the air is conveyed to the drum through an air circuit, a heating unit used to heat the air that is blown into the drum, and a condensing unit upstream of the heating unit for removing moisture, comprising:

conveying a predetermined fraction of the air flow in a by-pass between a first portion of the air circuit downstream of the condensing unit and a second portion downstream of the drum.

11. The process according to claim 10, wherein the first portion of the air circuit is upstream of the heating unit.

12. The process according to claim 10, wherein the second portion of the air circuit is upstream of the air blowing unit.

13. The process according to any of claim 10, wherein the fraction of the air flow conveyed in the by-pass comprised between approximately 10% and 20% of the total air flow.

14. The closed cycle dryer according to claim 5, wherein the condensing unit is positioned upstream of the air blowing unit.

15. The closed cycle dryer according to claim 4, wherein the air circuit is configured such that air from the drum and from the by-pass is mixed in the filter housing.

16. The closed cycle dryer according to claim 4, wherein the air circuit is configured such that air from the drum and from the by-pass is mixed upstream of the filter.

17. The process according to any of claim 10, wherein the closed cycle dryer further comprises a filter housing provided in the second portion of the air circuit, the process further comprising:

mixing air from the drum and air from the by-pass in the filter housing.

18. The process according to any of claim 10, wherein the closed cycle dryer further comprises a filter, the process further comprising:

mixing air from the drum and from the by-pass upstream of the filter.

19. The process according to any of claim 10, wherein the closed cycle dryer further comprises a filter, the process further comprising:

mixing air from the drum and from the by-pass downstream of the filter.

20. A closed cycle dryer comprising:

a drum;

an air circuit in fluid communication with the drum;

an air blowing unit provided in the air circuit and configured to convey air through the air circuit to the drum;

a heating unit configured to heat the air conveyed by the air blowing unit;

a condensing unit provided in the air circuit upstream of the heating unit for removing moisture; and an air by-pass between a first portion of the air circuit downstream of the condensing unit and a second portion of the air circuit downstream of the drum.

* * * * *